United States Patent [19]

Gerber

[11] Patent Number: 4,483,472

[45] Date of Patent: Nov. 20, 1984

[54] APPARATUS AND METHOD FOR INDEXING SHEET MATERIAL

[75] Inventor: Heinz J. Gerber, West Hartford, Conn.

[73] Assignee: Gerber Scientific Inc., South Windsor, Conn.

[21] Appl. No.: 471,131

[22] Filed: Mar. 1, 1983

[51] Int. Cl.[3] ..... B65H 25/26

[52] U.S. Cl. ..... 226/16; 226/159

[58] Field of Search ..... 226/15, 18–20, 226/3, 8, 150, 74, 159–162; 346/93, 114, 118, 134, 136; 242/67.4 D

[56] References Cited

U.S. PATENT DOCUMENTS

| | | | |
|---|---|---|---|
| 3,844,461 | 10/1974 | Robison et al. | 226/8 |
| 3,963,161 | 6/1976 | Jerney et al. | 226/150 |
| 4,091,980 | 5/1978 | Gerber | 226/162 |
| 4,131,224 | 12/1978 | Gerber et al. | 226/8 |

FOREIGN PATENT DOCUMENTS

| | | |
|---|---|---|
| 648366 | 1/1951 | United Kingdom . |
| 674181 | 6/1952 | United Kingdom . |
| 901525 | 7/1962 | United Kingdom . |
| 1075781 | 7/1967 | United Kingdom . |
| 1151312 | 5/1969 | United Kingdom . |

*Primary Examiner*—Leonard D. Christian
*Attorney, Agent, or Firm*—McCormick, Paulding & Huber

[57] ABSTRACT

An apparatus and associated method for indexing a strip of sheet material in fixed amounts along the support surface of a table enable an instrument supported from a carriage spanning the support surface to work on the material in precisely controlled segments and utilize one or two stops fixed in the table and movable engagement means operatively associated with the stops to limit the advancement of the sheet material as the material is indexed. The apparatus includes a transport mechanism connected for movement with the engagement means, and the sheet material is coupled to the transport mechanism for movement along the support surface. The stops define limits of travel of the engagement means and the transport mechanism to precisely fix the amount of advancement of the sheet material between work positions. The indexing operation includes positioning the engagement means at one of the limits of travel, coupling the material to the transport mechanism, and moving the mechanism and material along the support surface until the engagement means reaches another limit of travel.

14 Claims, 7 Drawing Figures

APPARATUS AND METHOD FOR INDEXING SHEET MATERIAL

BACKGROUND OF THE INVENTION

The present invention relates generally to a method and apparatus having a work table along which a strip of sheet material is indexed and relates more particularly to improved means for insuring that the sheet material is indexed in precisely controlled increments.

Prior art apparatus having a work table defining a support surface over which sheet material is spread while an instrument or tool which is supported on a carriage above the support surface performs a work operation on the material is disclosed in U.S. Pat. No. 4,091,980 having the same inventor as the present invention. Examples of instruments associated with such a work table include plotting pens or styluses, light heads, tracking heads and cutting or drilling tools. Typically, the carriage is movable over the support surface in one coordinate direction parallel to the support surface while the instrument, mounted on the carriage, is movable relative to the carriage and in another coordinate direction. Composite movements of the carriage and instrument allow the instrument to be translated to any coordinate position over the region of the support surface traversed by the carriage. Accurate positioning of the carriage and the instrument supported thereby may be achieved by numerical controls which may operate either from an on-line data generator or from previously programmed data.

The prior art apparatus also includes means for indexing long strips of the sheet material over the work table which is relatively short compared to the length of the strip. The indexing means advances or shifts the material across the surface of the table so that the instrument may operate on successive sections of the material.

The difficulty in working on successive sections of a strip of material is that movement of each section of the strip into working position must be precisely controlled to permit generation of continuous patterns which extend between adjacent sections of the strip. In a high resolution plotting system, for example, a series of plotted lines may extend continuously over several successive sections of a strip which is substantially longer than the plotting table. The strip indexing operation, unless accurately controlled, may cause discontinuies in the plot and results in plotted lines that are out of registration on adjacent sections.

If the indexing apparatus shown in U.S. Pat. No. 4,091,980 is not used, the amount of error in an indexing operation is typically dependant upon precise operation of belts, clutches or drive motors. However, if the belts stretch or clutches slip or if the motor shafts continue to rotate due to inertia effects after power to the motor is shut off, error in the indexing operation will result.

It is, accordingly, a general object of the present invention to provide an alternative to the apparatus in patent cited above, an apparatus and method for precisely controlling the amount of sheet material advancement across the work table. The invention obviates predictable error-producing phenomena associated with material indexing means of the prior art.

SUMMARY OF THE INVENTION

The present invention resides in an apparatus and method for precisely indexing sheet material over a work table to enable an instrument supported from a carriage spanning the work surface to perform an accurate work operation on the sheet material in segments.

The apparatus includes a table over which sheet material is spread to be worked on by an instrument movable back and forth parallel to the material and indexing means for moving the material between different work positions on the support surface. The indexing means includes a movable transport mechanism mounted to the table and means for coupling the movable transport mechanism and sheet material together for movement between the different work positions. Drive means are connected in driving relationship with the transport mechanism for powering the mechanism and the coupled sheet material. The apparatus also includes stop means mounted to the table and engagement means connected for movement with the transport mechanism The engagement means are operatively associated with the stop means for limiting the movement of the sheet material to a fixed and predetermined amount.

The method of the invention includes the steps of indexing a strip of sheet material utilizing the apparatus of the invention. At the beginning of an indexing operation, the engagement means is positioned at a limit of travel defined by the stop means, and the transport mechanism is coupled with the sheet material. The mechanism is then moved to advance the material along the table and to move the engagement means away from the limit of travel at which the means was first positioned for coupling. Movement of the transport mechanism and the material is halted when the engagement means reaches the other of the limits of travel, and the material is thus advanced a fixed and predetermined amount set by the limits.

Since the amount of sheet material advancement provided by the apparatus of this invention corresponds to the fixed distance that the engagement means travels along its path of travel between the movement limits defined by the stop means, successive indexing operations necessarily provide material segments which are uniform and accurate in length. Therefore, the error-producing phenomena associated with the material indexing means of the prior art are obivated by the apparatus and method of this invention.

DETAILED DESCRIPTION OF THE PREFERRED EMBODIMENTS

Figure 1:
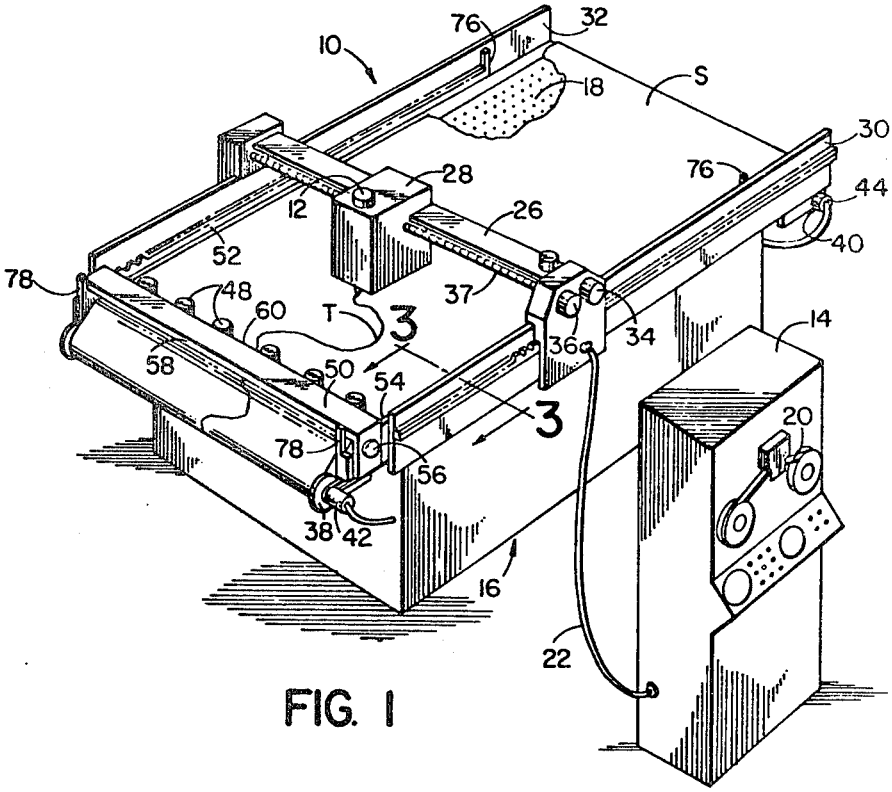
FIG. 1 is a perspective view of an automatically controlled plotter in which the present invention is embodied.

FIG. 1 shows an automatically controlled plotting apparatus, generally designated 10, which provides a typicial environment for the present invention. The plotting apparatus includes a plotting instrument or head 12 which produces graphical information on a strip S of sheet material formed, for example, of plotting paper. Although a plotting apparatus has been selected for illustration of the invention, it should be understood that the invention may be employed in and has utility in any type of automatically controlled system having an instrument or tool supported on a carriage for positioning over a strip of sheet material that is held stationary relative to the carriage during operation of the instrument. Thus, the invention may be employed in systems having tracking heads, cutting tools and numerous other instruments.

The numerically controlled plotting apparatus is comprised basically of a controller 14 which generates plotting commands, and a flat bed plotting table 16 which responds to the commands and causes a plotting head 12 to draw graphic information on the strip S spread over a support surface 18 defined on the table. The controller 14 reads a plotting program from a punched or magnetic tape 20 and converts the program into motor commands that are transmitted to drive motors on the plotting table 16 by way of a connecting cable 22.

The plotting head 12 is suspended over the table 16 above the support surface 18 by means of an X-carriage 26 and a Y-carriage 28. The X-carriage 26 translates back and forth in the illustrated X-coordinate direction on a set of outer racks 30 and 32, and the racks are engaged by an X-drive motor 34 through a pinion (not shown). The motor 34 is energized by command signals from the controller 14. The Y-carriage 28 is mounted on the X-carriage 26 for movement relative to the X-carriage in the Y-coordinate direction and is translated by the Y-drive motor 36 and the lead screw 37 connected between the motor and carriage. Like the drive motor 34, the drive motor 36 is also energized by command signals from the controller 12. Composite motions of the carriages 26 and 28 permit the plotting head 12 to be translated to any coordinate position on the support surface of the table.

The plotting head 12 may contain a pen, light head or other plotting instrument which is actuated whenever a line trace T or other graphic image is to be placed on the strip S of sheet material. Operation of the plotting instrument is also regulated by the controller 14.

Figure 2:
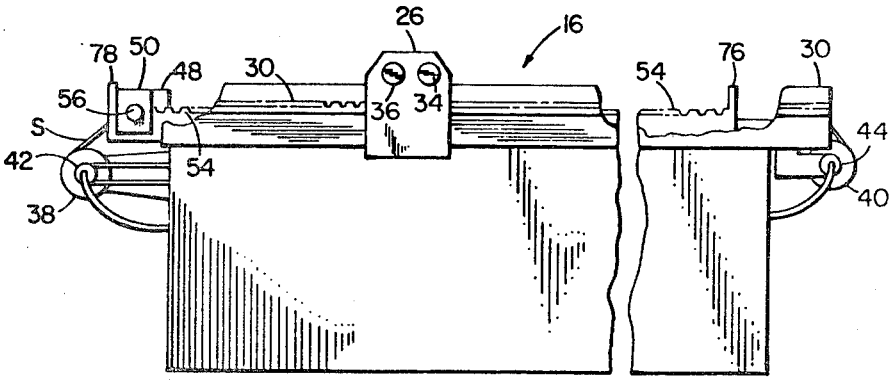
FIG. 2 is a side elevation view of the plotting table of FIG. 1, a portion of the outer carriage rack being cut away to expose the inner carriage rack.

As shown in FIGS. 1 and 2, the strip S of plotting material is supported on rolls or feed spools 38 and 40 held respectively by brackets at opposite longitudinal ends of the table 16. A torque motor 42 is drivably connected with one spool 38 and another torque motor 44 is drivably connected with the other spool 40 to hold a section of the strip S taut on the support surface of the plotting table. If separate clamps are provided at each end of the table, the torque motors may be utilized to maintain predetermined amounts of paper in loops at one or both ends of the table so that the material can be freely indexed between the spools 38 and 40 when desired.

Figure 3:
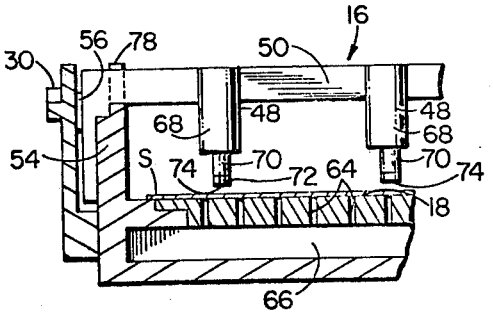
FIG. 3 is a fragmentary sectional view taken along the line 3—3 of FIG. 1.
Figure 4:
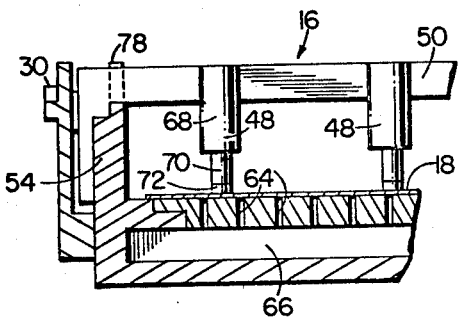
FIG. 4 is similar to FIG. 3, but shows the plungers of the coupling units in another position.

The support surface 18 of the table is preferably smooth and hard and has a low coefficient of friction relative to the sheet material which it is adapted to support. Materials such as aluminum, FORMICA, or plastic of a type which has a smooth relatively slippery surface may be used to make the table bed which defines the support surface. As shown in FIGS. 3 and 4, a plurality of small passageways 64, 64 formed in the bed of the table communicate with a vacuum chamber 66 immediately below the bed and comprise an integral element of a vacuum hold-down system. The passageways 64, 64 open through the support surface 18 in uniformly spaced parallel rows, as best shown in FIG. 1. A vacuum pump (not shown) is connected to the chamber 66 to evacuate it whereby the sheet material may be held in stationary position on the support surface by the vacuum holddown system in a manner well known in the art.

Since the apparatus 10 is capable of operating on only a limited section of the strip S, indexing means is provided for advancing or indexing the strip over the support surface of the table so that the plotting instrument of the plotting head 12 may operate on successive sections of the strip to generate the continuous trace T. Referring to FIGS. 1 and 2, the indexing means include a set of elongated inner racks 52, 54 positioned between the outer racks 30, 32 and a transport carriage 50 supported on the inner racks 52, 54 for transporting the material over the support surface in the indicated X-coordinate direction along a path of travel generally parallel to the work surface. The inner racks are toothed along the length of the support surface so as to mate with pinions (not shown) rotatably carried by the second carriage 50. The transport carriage 50 is driven along the set of racks 52, 54 and over the work surface by an X-drive motor 56 drivingly connected to the carriage pinions. The drive motor 56 is energized by command signals received from the controller 14.

The indexing means of the apparatus 10 also includes a plurality of frictional coupling units 48, 48 mounted in a series along the transport carriage 50 for releasably coupling the strip of material to the carriage 50 for movement therewith. Referring to FIGS. 3 and 4, each coupling unit 48 includes an actuator or electrical solenoid 68 which has a movable part or plunger 70. A friction shoe 72 made from high-friction material, such as rubber, cork or the like, is mounted in fixed position at the lower end of the plunger 70 and has a high-friction surface 74 generally parallel to the support surface 18. The plunger 70 is movable generally toward and away from an opposing portion of the support surface between coupled and release positions. When the coupling unit 48 is in its coupled position, the high friction surface 74 is disposed in frictional gripping engagement with the upper surface of the sheet material on the support surface as shown in FIG. 4, the lower surface of the material being in direct contact with an associated opposing portion of the stationary support surface 18.

Movement of the transport carriage 50 from one longitudinal end of the table to the other by means of the drive motor 56 while the coupling units are in their coupled position advances or indexes the strip of sheet material from one end of the table to the other. Each coupling unit 48 is then raised to its release position with the friction shoe 72 disposed a substantial distance above the support surface so that its high-friction surface 74 is out of frictional engagement with the material. The transport carriage 50 is then placed in a parking position at the one end of the table as shown in FIGS. 1 and 2, and the plotting operation continues with the plotting head 12 on the carriages 26 and 28. For a more complete description of the coupling units and the low-friction support surface with which the coupling units cooperate, reference may be had to U.S. Pat. No. 4,091,980 having the same inventor as the present invention.

In accordance with this invention, the apparatus 10 includes stop means and engagement means operatively associated with the stop means for limiting the amount of advancement of the strip of sheet material along the support surface during an indexing operation. The stop means of the apparatus 10 is provided by two pairs of stops 76, 76 and 78, 78 fixed to opposite ends of the inner racks 52, 54. The engagement means are connected to the transport carriage 50 of the apparatus 10, which moves the sheet material along the support surface. In the apparatus 10, the engagement means are provided by the flat sides 58 and 60 of the transport carriage 50 which abut the stops when the carriage 50 is moved in the X-coordinate direction to either of the longitudinal ends of the inner racks. The stops 76, 76 and 78, 78 are immovably fixed at the ends of the inner racks so that when the carriage 50 is driven by the drive motor 56 into engagement with either pair of the stops, the advancing movement of the drive motor 56 is overcome and the carriage 50 halts. At the moment of engagement of the carriage sides 58 or 60 and the stops, the controller 14 senses the increase in driving torque and deenergizes the drive motor 56. Therefore, for indexing, the sheet material is coupled to the transport carriage 50 while in engagement with one pair of the stops 76, 76 and also during movement of the carriage to the opposite end of the table where the carriage engages the other pair of stops 78, 78. The material is then released. Under these circumstances, the material is indexed a fixed amount equal to the movement between the stops.

During a plotting operation performed on a segment of material as shown in FIGS. 1 and 2, the sheet material is held fixed in a first work position against the support surface 18 of the table by the vacuum hold-down system while the plotting head 12 generates a trace T thereon in response to instrument positioning signals received from the controller 14. Throughout the plotting operation, the transport carriage 50, with the coupling units in their release positions, is parked outside of the work area of the plotting head and beyond the lefthand extremity of the outer racks 30, 32 as shown in FIG. 2.

When the head 12 has completed its operation on the spread segment of material, the instrument is lifted from engagement with the material in response to command signals from the controller 14, and the X-carriage 26 is moved to a position outside the area of the support surface over which the transport carriage may move or, as in FIG. 2, to the right-hand end of the table. The transport carriage 50 is thereafter moved along its associated racks 52, 54 until it engages and is positioned against the stops 76, 76 located at one end of the racks. Another signal from the controller 14 causes the plungers 70, 70 of the coupling units 48, 48 to move to the coupled position whereupon a further signal from the controller causes de-energization of the vacuum hold-down system to release the spread sheet material from the support surface 18 of the table. The carriage 50, which is now frictionally coupled to the material by the various coupling mechanisms 48, 48, advances the material toward the opposite end of the table and positions a new segment of material on the support surface 18.

The advancement of the material halts upon engagement of the carriage 50 with the stops 78, 78 located at the end of the inner racks 52 and 54. The vacuum hold-down system is reenergized on signal from the controller 14 to hold the material stationary in a second defined work position on the surface 18 with the new segment located in the work area of the head 12. Further signals from the controller move the frictional coupling units 48, 48 to the release position and cause the X-carriage 26 and Y-carriage 28 to position the head 12 over the work area of the table and resume plotting of the trace T.

While the material is being advanced, the torque motor 42 may be slaved to the carriage 50 by the controller 14. During slaving, the torque motor 44 is de-energized and the torque motor 42 is energized to apply a slight driving torque to its associated roll and a pulling force to the strip S in coordination with the movement of the carriage 50.

Figure 5:
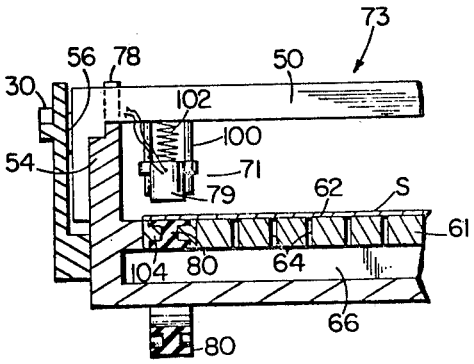
FIG. 5 is a fragmentary end view similar to FIG. 3 showing in detail another embodiment of a plotting table bed and a coupling unit.

FIG. 5 illustrates another embodiment of a coupling unit, generally designated 71, and a plotting table, generally designated 73, in accordance with the indexing means of this invention. Various components of the table 73 which correspond to components of the table 16 of FIGS. 1-4 bear the same reference numerals. The coupling unit 71 is comprised of an electromagnet 79 resiliently supported below the transport carriage 50 and a magnetically permeable band or belt 80 which encircles the bed 61 of the table. The belt 80 is supported at the longitudinal ends of the table by tensioning rollers so that the portions of the belt extending above and below the bed may be moved freely relative to the table in the X-coordinate direction. A corresponding belt and electromagnet (not shown) are mounted on the table and carriage 50 respectively at the opposite side of the table.

The electromagnet 79 is slidably supported on the rods 100 projecting downwardly from the carriage 50 and is attracted to and couples with the belt when energized. The magnet 79 is guided precisely in the vertical direction by the rods and a return spring 102 supports the magnet so that its lower end is spaced slightly above the sheet material, as shown, when the magnet is de-energized.

As illustrated, the belt 80 has an I-shaped cross section and is mounted in the bed in a corresponding I-shaped groove defined in a track 104. The track 104 is fixedly mounted in the bed and is constructed of a magnetically reluctant material so that the electromagnet 79 and the belt 80 readily slide relative to the track. The track 104 and the belt 80 have an upper surface which is level with the support surface 62 of the bed.

In operation, the strip S of plotting material is spread over the support surface 62 of the table 73 so that the lateral edges of the material lie on the top of the belt 80 and the corresponding belt at the opposite side of the table. To couple the plotting material with the carriage 50, the electromagnet 79 is energized and attracted to the belt 80 to clamp the edge of the material between the belt and the magnet. The carriage drive motor 56 is then energized to move the carriage 50 along the table in the X-direction while the belt and material move the carriage. Again, movement of the carriage 50 from engagement with the pair of stops 76, 76 at one end of the table into engagement with the pair of stops 78, 78 at the other end precisely indexes the material by a fixed amount.

Figure 7:
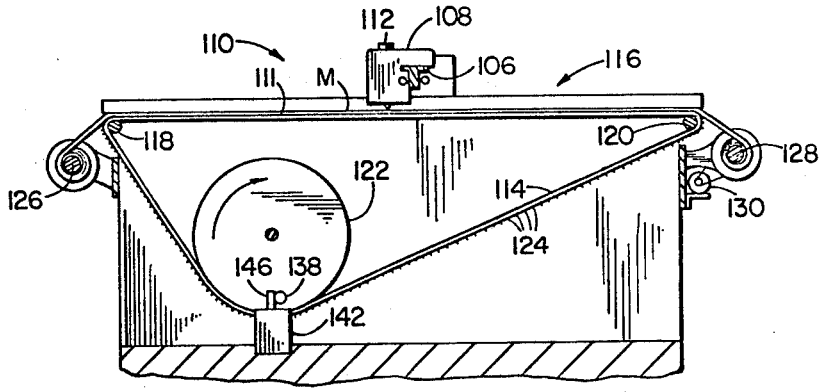
FIG. 7 is a side elevation view of the plotting table of FIG. 6 as seen along the sectioning line 7—7 of FIG. 6.
Figure 6:
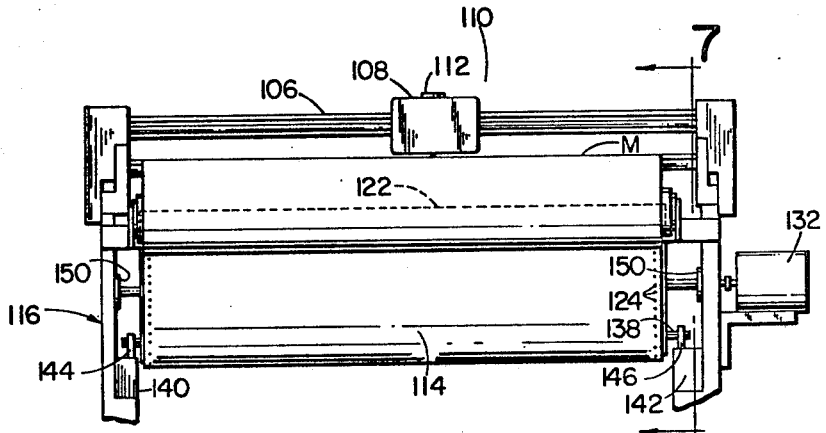
FIG. 6 is an end view of a table of an alternative plotter in which the present invention is embodied.

FIGS. 6 and 7 illustrate still another plotting apparatus in which this invention is embodied. This apparatus, indicated generally 110, includes a flat bed plotting table, indicated generally 116, defining a material supporting surface 111 and a plotting head 112 mounted for horizontal movement in two coordinate directions above the support surface 111 by means of an X-carriage 106 and a Y-carriage 108 mounted on racks of the table. Also included in the plotting apparatus 110 is a controller (not shown) operatively connected to the table 116 for controlling the operation of the carriage drive motors. The sheet material upon which a plotting operation is performed in segments is a long strip M of material, such as plotting paper, supported at each end upon rolls or feed spools 126 and 128 respectively held by brackets at opposite longitudinal ends of the table 116. A torque motor 130 is drivingly connected to the spool 128 to take up the sheet material while the material is advanced lengthwise across the the table as will be hereinafter described.

The plotting apparatus 110 further includes indexing means for advancing the strip M of material across the table. The indexing means includes an endless conveyor belt 114 tightly looped around two rollers 118 and 120, respectively, supported at opposite longitudinal ends of the table and a drum 122. The support surface 111 of the table upon which the material is spread to be worked upon by the instrument of the head 112 is defined by the upper surface of the portion of belt 114 which is stretched between the two rollers 118 and 120. The belt is provided along each of its opposite lateral edges with a plurality of spaced, outwardly extending pin-shaped projections 124, 124 which engage sprocket holes along the longitudinal edges of the material so that the material is transported jointly with the upper portion of the belt 114.

The drum 122 is arranged with its shaft positioned parallel to the table surface and the drum shaft is rotatably supported within bearings 150, 152 fixed in opposite sides of the table 116. A drive motor 132, mounted in the table, is directly coupled to the drum shaft for rotating the drum in response to command signals received from the controller. The surface of the drum is in frictional gripping engagement with the conveyor belt 114 to drive the upper portion of the belt with the material from one longitudinal end of the table to the other as the drum is rotated by the drive motor 132. Two cylindrical pegs 136 and 138 are fixed respectively to opposite ends of the drum and extend outwardly therefrom. The pegs are arranged so that their longitudinal axes are parallel to the drum shaft and in coaxial alignment with one another. When the drum 122 is rotated so as to transport the strip M along the table bed, the pegs follow a closed, circular path of movement.

The stop means which limits the amount of travel of the sheet material M in an indexing operation is provided by two electrical solenoids 140 and 142, each mounted to opposite sides of the table. Each solenoid has a plunger 144, 146, respectively, movable generally along a vertical axis between an uppermost position, as shown in FIGS. 6 and 7, at which the plunger is situated in the circular path of movement of an associated drum peg 136 or 138, and a lowermost position at which the plunger is situated below and out of the path of peg movement. The plungers 144, 146 are in their lowermost position when the solenoids are energized and in their uppermost positions when the solenoids are deenergized. The solenoids are synchronized with one another and are energized and deenergized by the controller.

While the instrument of the head 112 performs a plotting operation on a segment of the strip M of material spread on the table 116, the drum pegs 136 and 138 are positioned in engagement with their associated plungers. For indexing, the drum 122 turns clockwise as indicated by the arrow in FIG. 7 to advance the strip of material across the table and, accordingly, the drum peg 138 is shown in engagement with the right side of the plunger 146 as the head 112 works on the material.

When the strip M of material is advanced, the solenoids 140, 142 are energized so that the plungers are drawn to their lowermost position and the drum drive motor 132 rotates the drum. The drum rotation forces the upper portion of belt 114 and strip of material to advance along the length of the table. However, before the drum 122 completes one revolution, each solenoid 140 and 142 is de-energized so that the plungers 144, 146 return to their uppermost positions in the circular paths of the drum pegs 136, 138. The eventual engagement of the drum pegs and the plungers halts the rotation of the drum and prevents further advancement of the sheet material. The sudden increase in torque of the drive motor 132 upon engagement of the pegs and plungers is sensed by the controller which immediately de-energizes the drive motor 132. Since the drum is permitted by the pegs 136, 138 to rotate exactly one revolution during a single material-indexing operation, the material is precisely indexed an amount equal to the circumference of the drum.

It will be understood that numerous modifications may be had to the aforedescribed embodiments of this invention without departing from the spirit of the invention. For example, although each embodiment provides a direct connection between the material engagement means and the motor means for moving the material across the support surface, such a direct connection is not essential to the invention. A modification may be made to the FIG. 6 embodiment by connecting the drive motor 132 with the roller 120 instead of the drum 122 as shown. The pegs 136 and 138 will move along a closed, circular path with the drum and again precisely limit the displacement of the strip M of material over the table. The transport carriage 50 can be releasably connected to the X-carriage 26 for indexing material by means of the X-drive motor 34, and the stops may engage the carriage 50 as described in connection with FIG. 1. In this event, the separate drive motor 56 and racks 52, 54 are not needed. Magnetic, mechanical and electrical couplings between the material transport mechanism and the sheet material have been disclosed, but pneumatic, hydraulic and other couplings may be used with equivalent results. Accordingly, the embodiments described herein are intended as illustrations and not as limitations.

I claim:

1. In an apparatus having a table defining a support on which sheet material is spread in first and second coordinate directions, an instrument for working on the sheet material spread over the table, the instrument being mounted on a first motor-controlled carriage spanning the table in the second coordinate direction and mounted on a first set of ways extending in the first coordinate direction for controllable movement back and forth parallel to the support surface and relative to the sheet material for accurate positioning and working on the sheet material, the improvement comprising:

indexing means for moving the sheet material in the first of the two coordinate directions between different work positions on the table and including a second carriage also spanning the table in the second coordinate direction parallel to the first carriage and mounted to the table on a second set of ways different from but parallel to the first set for movement in the first coordinate direction, means for coupling the second carriage and the sheet material together and drive motor means connected in driving relationship with the second carriage for moving the carriage and the coupled sheet material over the table in the first coordinate direction between different work positions; and stop means mounted to the table in noninterfering relationship with the movement of the first carriage on the first set of ways and engagement means connected for movement with the second carriage and operatively associated with the stop means for limiting the movement of the second carriage and the coupled sheet material in the first coordinate direction between work positions on the table to a fixed and predetermined amount.

2. Apparatus as set forth in claim 1 wherein the means for coupling the sheet material and second carriage includes means for releasably coupling the material to the carriage.

3. Apparatus as set forth in claim 1 wherein the engagement means is mounted for movement along an established path of the second carriage, and the stop means includes a stop mounted in the established path of movement of the engagement means for engaging the engagement means when the second carriage and the coupled sheet material have advanced the predetermined amount.

4. Apparatus as set forth in claim 1 wherein the the second carriage is self-propelled, and an elongated drive rack extends along the table in the first coordinate direction and is engaged by the second carriage for movement between said ends of the table, and the stop means includes first and second stops fixedly attached at opposite ends of the rack to limit the movement of the second carriage and coupled sheet material.

5. Apparatus as set forth in claim 1 wherein the means for coupling includes a plurality of coupling units mounted in transversely spaced series along the second carriage to travel therewith, each coupling unit including a friction shoe having a high-friction surface and means for moving the friction shoe generally toward and away from sheet material on the table and the table includes a smooth bed of material defining a support surface providing a low coefficient of friction between the sheet material and the table.

6. Apparatus as set forth in claim 1 further including an endless belt having a portion extending along the table in the first coordinate direction, and wherein the means for coupling comprises a clamp supported by the second carriage over the spread material and having a clamping portion movable toward and away from the belt between a coupling position at which the clamping portion holds the material against the belt and a release position at which the clamping portion is out of engagement with the material.

7. The apparatus of claim 6 wherein the endless belt is magnetically permeable and the clamping portion is an electrically actuated magnet for magnetically coupling the material to the second carriage.

8. In an apparatus having a table defining a support surface on which sheet material is spread in two coordinate directions, an instrument for working on the sheet material spread on the table, and the instrument being mounted for controllable movement back and forth parallel to the support surface and relative to the sheet material for accurate positioning and working on the sheet material, the improvement comprising:

indexing means for moving the sheet material in one of the two coordinate directions between different work positions on the table and including a movable transport mechanism having an endless belt with one portion to which the sheet material is coupled extending over the support surface, means for coupling the endless belt and the sheet material together, a drum rotatably supported in the table and engaged with the belt, and drive motor means connected in driving relationship through the drum with the belt for moving the belt and the coupled sheet material over the table in the one coordinate direction between different work positions; and stop means mounted to the table and engagement means connected for movement with the transport mechanism and operatively associated with the stop means for limiting the movement of the sheet material in the one coordinate direction between work positions on the table to a fixed and predetermined amount.

9. Apparatus as set forth in claim 8 wherein the engagement means is fixedly attached the drum to follow a circular path as the drum is rotated by the drive motor means and as the belt portion is moved along the support surface; and the stop means includes a solenoid-activated plunger movable between a position at which the plunger is in the circular path of movement of the engagement means and a position at which the plunger is out of the path of the engagement means.

10. A method of indexing a strip of sheet material a fixed amount in the lengthwise direction of the strip between different work positions along the support surface of a table, the table being part of an apparatus for performing a work operation on the sheet material in segments by means of a first transport mechanism moving a work tool over the table parallel to the lengthwise direction of the strip, the method comprising the steps of:

providing the apparatus with a second transport mechanism and mounting the second mechanism for movement relative to the table in the lengthwise direction;

further providing the apparatus with stop means and cooperative engagement means associated with the second transport mechanism and connecting the engagement means for movement with the movable second mechanism between limits of travel established by engagement of the engagement means with the stop means thereby limiting the movement of the movable second transport mechanism to a fixed and predetermined amount without limiting the movement of the first transport mechanism;

positioning the second transport mechanism and the engagement means in engagement with the stop means at one limit of travel;

coupling the sheet material and the second transport mechanism together;

moving the second transport mechanism to advance the sheet material along the support surface of the table and the engagement means from the one limit toward the other; and halting the movement of the second transport mechanism and the material coupled therewith when the engagement means reaches the other limit of travel whereby the material is advanced a fixed and predetermined amount.

11. The method of indexing as defined in claim 10 including the step of releasing the sheet material from the second transport mechanism after the step of halting.

12. The method of indexing as defined in claim 11 further including the steps of returning the second transport mechanism and the engagement means from the one limit to the other and thereafter repeating in sequence the steps of coupling, moving, and halting to index the material by another fixed and predetermined amount.

13. A method for precisely indexing as defined in claim 10 wherein the step of coupling occurs simultaneously with the step of positioning.

14. The method of indexing as defined in claim 10 wherein the limits of travel are established by an engagement means which travels with the movement of the second transport mechanism in a closed path, and the stop means is movable into and out of the path of the engagement means.

* * * * *